US006471035B1

(12) United States Patent
Ruchti et al.

(10) Patent No.: US 6,471,035 B1
(45) Date of Patent: Oct. 29, 2002

(54) MULTI-STAGE METAL-FORMING MACHINE TOOL

(75) Inventors: Daniel Ruchti, Bretzwil; Ulrich Fluri, Breitenbach; Heinz Dettwiler, Lupsingen, all of (CH)

(73) Assignee: Hatebur Umformmaschinen AG, Reinach (CH)

( * ) Notice: Subject to any disclaimer, the term of this patent is extended or adjusted under 35 U.S.C. 154(b) by 0 days.

(21) Appl. No.: 09/424,894

(22) PCT Filed: Jun. 9, 1998

(86) PCT No.: PCT/CH98/00249

§ 371 (c)(1),
(2), (4) Date: Nov. 30, 1999

(87) PCT Pub. No.: WO98/57765

PCT Pub. Date: Dec. 23, 1998

(30) Foreign Application Priority Data

Jun. 13, 1997 (CH) ..... 1449/97

(51) Int. Cl.[7] ..... B21K 1/04

(52) U.S. Cl. ..... 198/339.1; 198/550.4; 83/719

(58) Field of Search ..... 198/526, 601, 198/339.1, 578, 550.4; 83/719

(56) References Cited

U.S. PATENT DOCUMENTS 3,602,078 A 8/1971 Schindler
3,736,827 A 6/1973 Hof
3,968,674 A 7/1976 Ishida
4,382,737 A * 5/1983 Jensen et al. ..... 413/56 X
4,407,630 A * 10/1983 Toda ..... 414/786 X
4,631,950 A 12/1986 Hay et al.
6,032,505 A * 3/2000 Stodd ..... 72/336 X
6,267,220 B1 * 7/2001 Croston ..... 198/339.1
6,293,386 B1 * 9/2001 Telkamp et al. ..... 198/339.1

FOREIGN PATENT DOCUMENTS

CH 398316 3/1966
CH 553014 8/1974
DE 3517637 11/1985

* cited by examiner

*Primary Examiner*—Donald P. Walsh
*Assistant Examiner*—Kenneth W Bower
(74) *Attorney, Agent, or Firm*—Selitto, Behr & Kim

(57) ABSTRACT

A multi-stage forming machine with a final forming station for dividing combined parts into in each case two product parts (21, 22) has two product-part discharge devices (3, 4). Assigned to the two product-part discharge devices (3, 4) there is in each case a transfer device (6) for transferring a product part (21, 22) from the final forming station to the product-part discharge device (3, 4). The one transfer device comprises transfer tongs with an upper gripper with two gripping jaws (521, 522) and a lower gripper with one gripping jaw (531). The other transfer device (6) comprises a slideway (61) for receiving a product part (22) from the final forming station and also a kick lever (62) arranged such that it can swivel for pushing a product part (22) located on the slideway (61) to the product-part discharge device (4).

19 Claims, 8 Drawing Sheets

MULTI-STAGE METAL-FORMING MACHINE TOOL

FIELD OF THE INVENTION

The present invention relates to a multi-stage forming machine with a final forming station for dividing combined parts into in each case at least two product parts.

BACKGROUND OF THE INVENTION

Multi-stage forming machines, which divide combined parts into two product parts in a final forming station are used, for example, for producing ball bearing races. In the case of most known forming machines, the product parts produced, for example an inner race and an outer race, fall under their own weight onto a chute arranged beneath the forming station and slide on the said chute out of the forming region of the forming machine.

These forming machines have a whole series of disadvantages. For instance, the machine speed is restricted by the falling of the product parts, dependent on acceleration due to gravity. The product parts themselves may possibly suffer surface damage due to striking the chute, which leads to inaccuracies and makes reworking necessary. Therefore, it is not possible for the forming machine to produce accurately finished product parts.

A further disadvantage is that the product parts are discharged in a disorderly manner. There is no clear production sequence of the discharged product parts, with the result that quality control and possible readjustment of the forming machine and the rejection of defective product parts are made more difficult. This has the effect that, in particular in the case of safety parts, too many possibly defective product parts have to be rejected. In addition, it is necessary in a subsequent separate operation for the two types of product part produced to be sorted and possibly for the product parts to be aligned suitably for the operations which follow.

In the case of multi-stage forming machines for producing a single product part per working cycle, it has been possible to eliminate some of the corresponding disadvantages by arranging transfer tongs at the final forming station for transferring the product part into the discharge chute. Such a forming machine is described in DE 35 17 637 A1. However, it is not possible with this forming machine to produce two product parts from a combined part and then discharge them separately whilst carrying out control checks.

SUMMARY OF THE INVENTION

In view of the disadvantages of the previously known multi-stage forming machines described above, the invention is based on the following object. There is to be provided a multi-stage forming machine of the type mentioned at the beginning in which product parts produced from a combined part can be discharged from the final forming station quickly, separately and whilst carrying out control checks.

This object is achieved by the forming machine according to the present invention design variants emerge from the.

The essence of the invention is that a multi-stage forming machine with a final forming station for dividing combined parts into in each case two product parts has at least two product-part discharge devices, to which there is in each case assigned a transfer device for transferring a product part from the final forming station to the product-part discharge device.

The fact that the forming machine has at least two product-part discharge devices with assigned transfer devices means that, after dividing a combined part in the final forming station, each product part can be discharged separately.

The transfer devices make it possible for the product parts to be discharged from the final forming station quickly and whilst carrying out control checks. Thanks to the transfer devices, the speed of the forming machine is no longer restricted by the falling speed of the product parts. Moreover, the product parts can be discharged in an alignment suitable for the operations which follow and in a time-controlled manner. Discharging in a way corresponding to the production sequence and whilst carrying out control checks also makes identification of the product parts possible, which considerably facilitates accurate quality control, possible readjustment of the forming machine and rejection of defective product parts. For example, if defective product parts occur on account of transitions of bars from which the combined parts are produced, rejection can be restricted to the product parts directly affected. It is no longer necessary for reasons of safety to reject all the possibly defective product parts discharged in a certain period of time.

Thanks to the transfer devices, the product parts can also be produced more accurately with the forming machine, since the product parts do not strike the chute at high speed as they do in the case of the prior-art forming machines mentioned. The avoidance of surface damage, or at least great reduction in surface damage, makes it possible to reduce or even omit entirely the machining allowances on the product parts.

The multi-stage forming machine according to the invention is described in more detail hereinbelow on the basis of two exemplary embodiments and with reference to the attached drawings, in which:

DESCRIPTION OF THE PREFERRED EMBODIMENT

Figure 1:
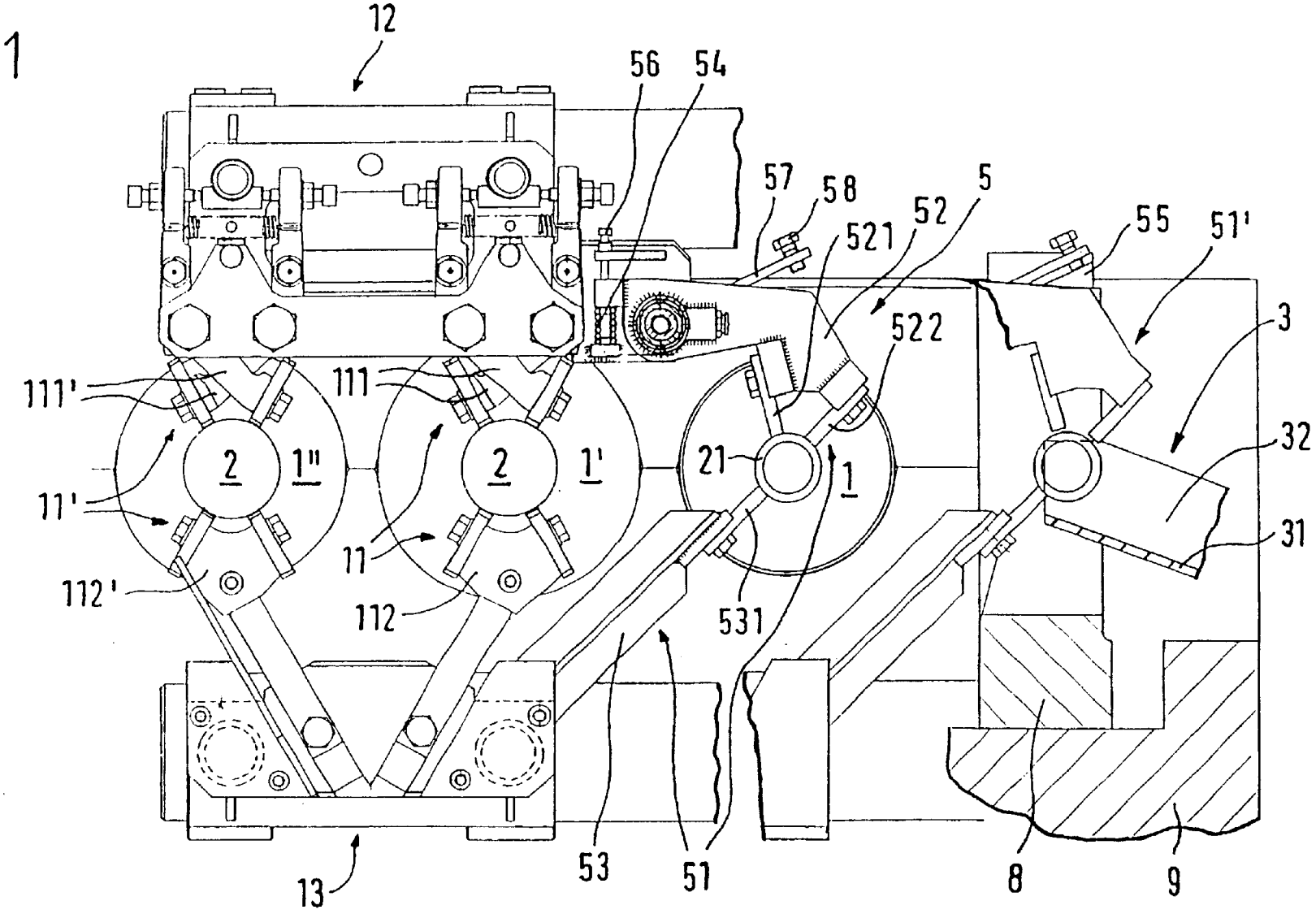
FIG. 1 shows a section through part of a multi-stage forming machine according to the invention with transfer tongs in two positions.
Figure 2:
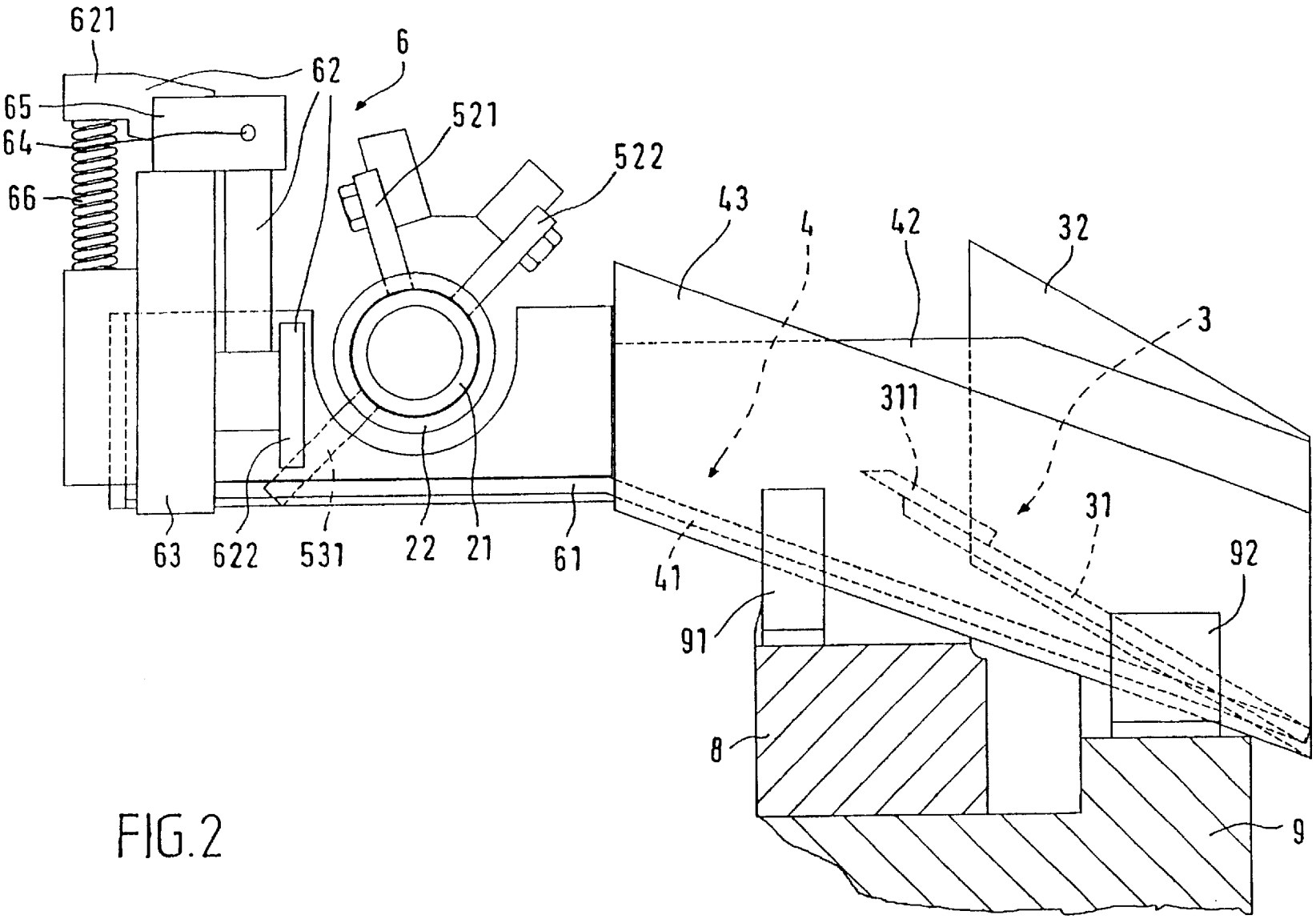
FIG. 2 shows a side view of a first exemplary embodiment of the product-part unloading part of a multi-stage forming machine according to the invention with a first transfer device with transfer tongs and a second transfer device with a kick lever in the position of rest.
Figure 3:
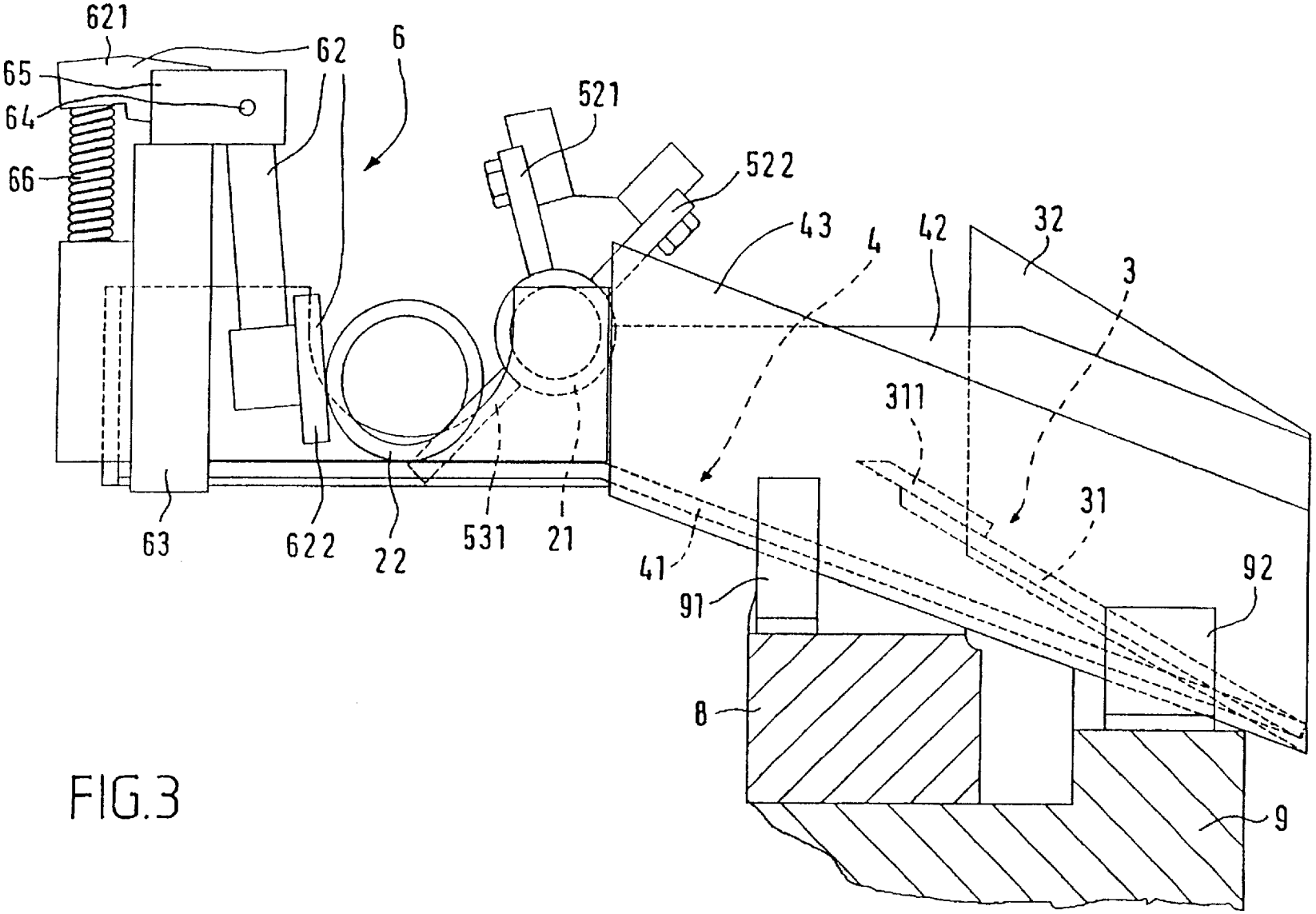
FIG. 3 shows the product-part unloading part from FIG. 2 with the kick lever in the pushing position.
Figure 4:
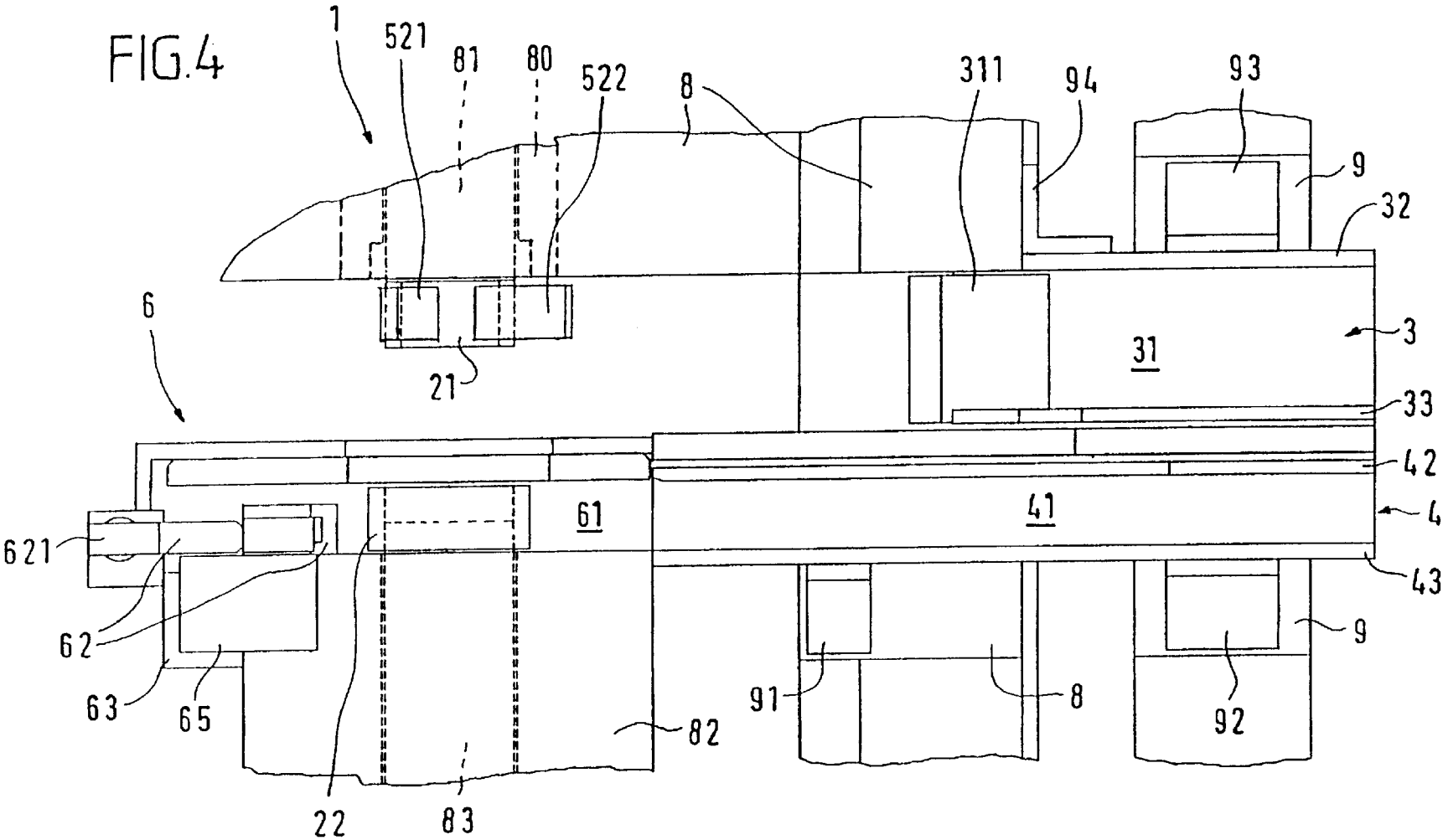
FIG. 4 shows a plan view of the product-part unloading part from FIG. 2.
Figure 5:
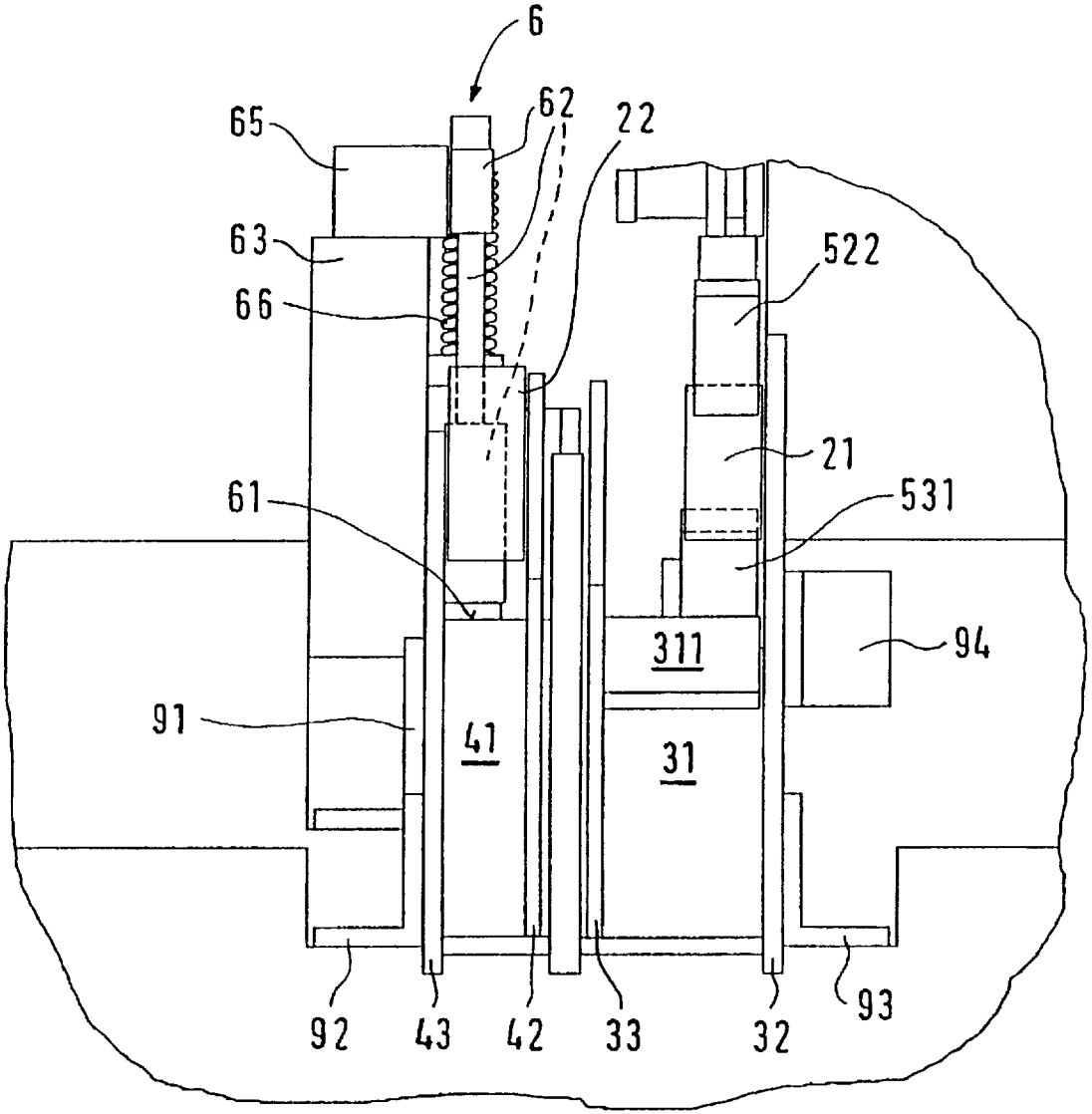
FIG. 5 shows a view from the front of the product-part unloading part from FIG. 2.

With reference to FIG. 1, the multi-stage forming machine represented has three forming stations 1", 1' and 1, combined parts 2 being divided into in each case two product parts in the final forming station 1. In the final forming station 1 there can be seen only the one product part 21, here in the form of an inner race; the other product part, an outer race in the case of the present exemplary embodiment, has already been separated from the said inner race and removed. The combined parts 2 are transported by tongs 11' from the forming station 1" to the forming station 1' and by tongs 11 from the forming station 1' to the forming station 1. The tongs 11' and 11 have in each case an upper gripper 111' and 111, respectively, and a lower gripper 112' and 112, respectively, which are fitted on an upper tongs carrier 12 and a lower tongs carrier 13, respectively. The transverse conveyance of the tongs 11' and 11 takes place by displacing-the tongs carriers 12 and 13.

For discharging the one product part 21 there is provided a product-part discharge device 3, which is assigned a transfer device 5 for transferring the product part 21 from the final forming station 1 to the product-part discharge device 3.

The product-part discharge device 3 comprises an obliquely arranged chute 31, which is bounded by two side walls, of which only the side wall 32 can be seen here, and on which the product parts 21 slide out from the forming region of the forming machine.

The transfer device 5 has transfer tongs 51 with an upper gripper 52 and a lower gripper 53, which are fastened pivotably on the upper tongs carrier 12 in the case of the upper gripper and rigidly on the lower tongs carrier 13 in the case of the lower gripper and which grippers are transversely conveyed by means of these two tongs carriers from the final forming station 1 to the product-part discharge device 3 and vice versa. A screw 56 acts as an adjustable stop for the upper gripper 52. A product part 21 is held from above by means of two adjustable gripping jaws 521, 522 of the upper gripper 52 and from below by means of an adjustable gripping jaw 531 of the lower gripper 53. The side of the gripped product part 21 facing the product-part discharge device 3 is free, with the result that the product part 21 can be placed onto the chute 31 without the transfer tongs 51 touching the latter.

In order that the product part 21 is transported with a certain pretensioning when the transfer tongs 51 are closed, the upper gripper 52 is pretensioned in the gripping direction by a pretensioning spring 54. To prevent the product part 21 from being propelled downwards by the pretensioning of the upper gripper 52 when the transfer tongs 51 are opened, there is provided a preopening device, which already moves the upper gripper 52 a certain amount in the opening direction shortly before reaching the product-part discharge device 3. In the present case, the preopening device comprises a ramp 55, which is fitted on the anvil 8 and onto which there can move a preopening screw 58, which is screwed into a fastening plate 57 arranged on the upper gripper 52. By adjusting the preopening screw 58, the preopening amount of the upper gripper 52 can be set.

51' denotes the transfer tongs 51 in the extreme position on the side of the product-part discharge device and 9 denotes the machine body.

The following statement applies to the entire further description. If reference numerals are contained in a figure for the purpose of clarifying the drawing but are not explained in the directly associated descriptive text, reference is made to where they are mentioned in previous descriptions of figures.

With reference to FIGS. 2 to 5, the product-part unloading part represented here of a forming machine according to the invention comprises a first transfer device with transfer tongs according to FIG. 1, of which only the visible gripping jaws 521, 522 and 531 are depicted for reasons of overall clarity, a first product-part discharge device 3, assigned to the first transfer device, a second transfer device 6 and a second product-part discharge device 4, assigned to the latter.

The first product-part discharge device 3 is constructed in a similar manner to the product-part discharge device represented in FIG. 1. The only difference is that the chute 31 has an end part 311 which is displaceable in the longitudinal direction. This end part 311 is displaced in the direction of the final forming station 1 for receiving relatively small product parts 21, with the result that even relatively small product parts 21 are placed on by the transfer tongs in such a way that they slide down the chute 31. Fastening angles 93 and 94 serve for fastening the product-part discharge device 3 on the machine body 9 and on the anvil 8, respectively.

The second product-part discharge device 4 comprises an obliquely arranged chute 41, which is bounded by two side walls 42 and 43 and on which the product parts 22, here in the form of outer races, slide out of the forming region of the forming machine. Fastening angles 91 and 92 serve for the fastening of the product-part discharge device 4 on the machine body 9 and on the anvil 8, respectively.

The transfer device 6 for transferring a product part 22 from the final forming station 1 to the product-part discharge device 4 comprises a slideway 61, arranged between the final forming station 1 and the product-part discharge device 4, for receiving a product part 22 from the final forming station 1, and also a pushing device for pushing a product part 22 located on the slideway 61 onto the chute 41 of the product-part discharge device 4. In the present case, the pushing device has a kick lever 62, which is arranged on a fixed part 65 such that it can swivel about a pivot axis 64. The fixed part 65 is fastened by means of an anchorage part 63 on a stripper 82 (see below). By impact on the lever arm 621 of the kick lever 62, for example by means of a knock-out bar of the forming machine, its kick plate 622 is deflected in the direction of the product-part discharge device 4 (see FIG. 3) and imparts momentum to a product part 22 located on the slideway 61, causing the product part to be moved to the chute 41 of the product-part discharge device 4. Thereafter, a helical spring 66 presses the lever arm 621 upwards again and thus brings the kick lever 62 back into its position of rest (see FIGS. 2, 4 and 5).

The transfer of the product parts 21 and 22 out of the final forming station 1 to the product-part discharge devices 3 and 4, respectively, may take place simultaneously or at different times. After the separating of the two product parts 21, 22 by a male die 83 in a female die 80, the product part 22 is drawn out of the female die 80 by the withdrawal of the male die 83 and is stripped off the male die 83 at the stripper 82 and thus arrives on the slideway 61. The product part 21 is pushed out of the female die 80 by means of a knock-out mechanism 81 and either arrives directly in the closed transfer tongs or is gripped by the closing transfer tongs. Thereafter, the transfer of the product parts 21 and 22 takes place as described above to the product-part discharge devices 3 and 4, respectively.

Figure 6:
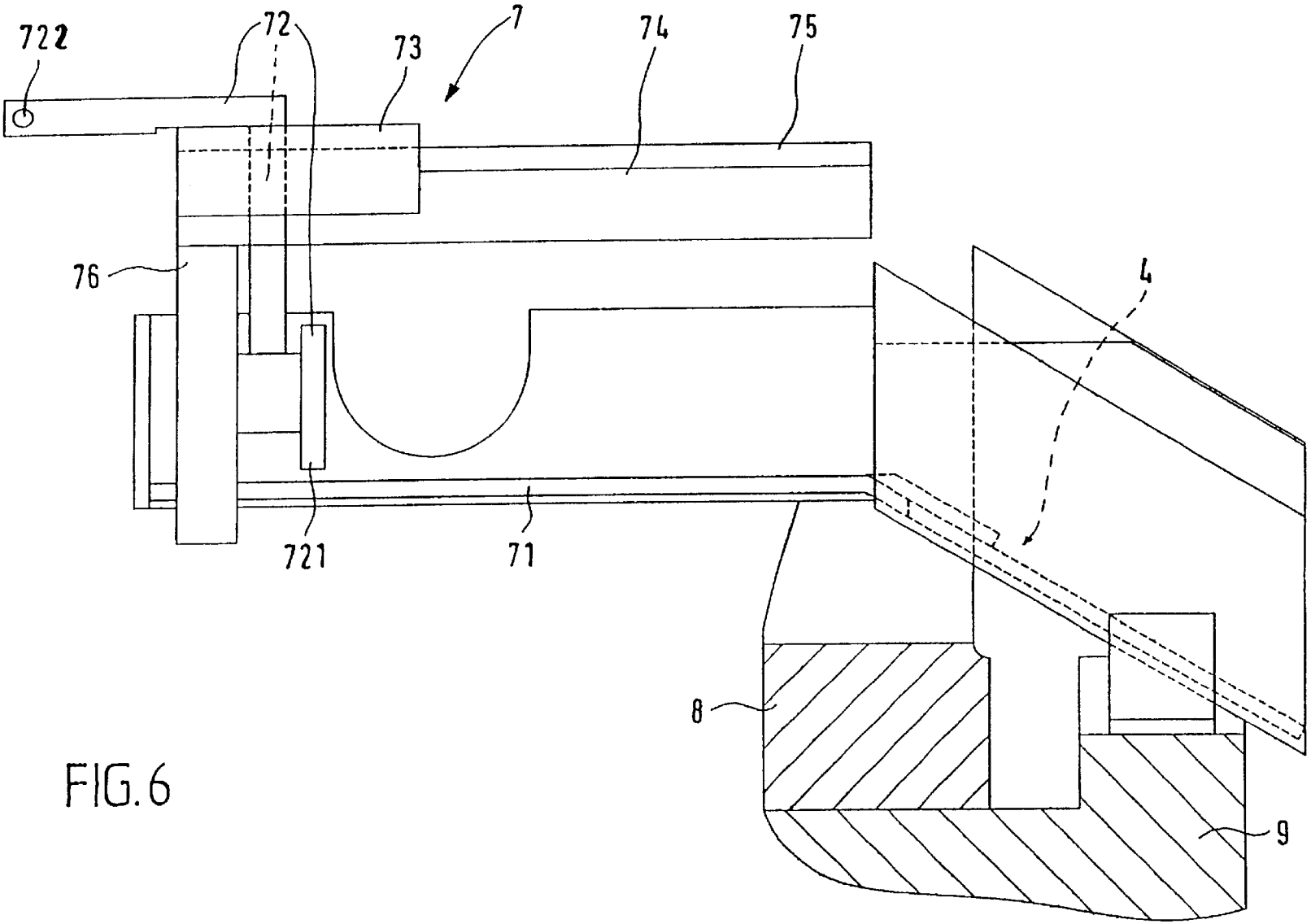
FIG. 6 shows a side view of a second exemplary embodiment of the product-part unloading part of a multi-stage forming machine according to the invention with a first transfer device with transfer tongs and a second transfer device with a pusher.
Figure 7:
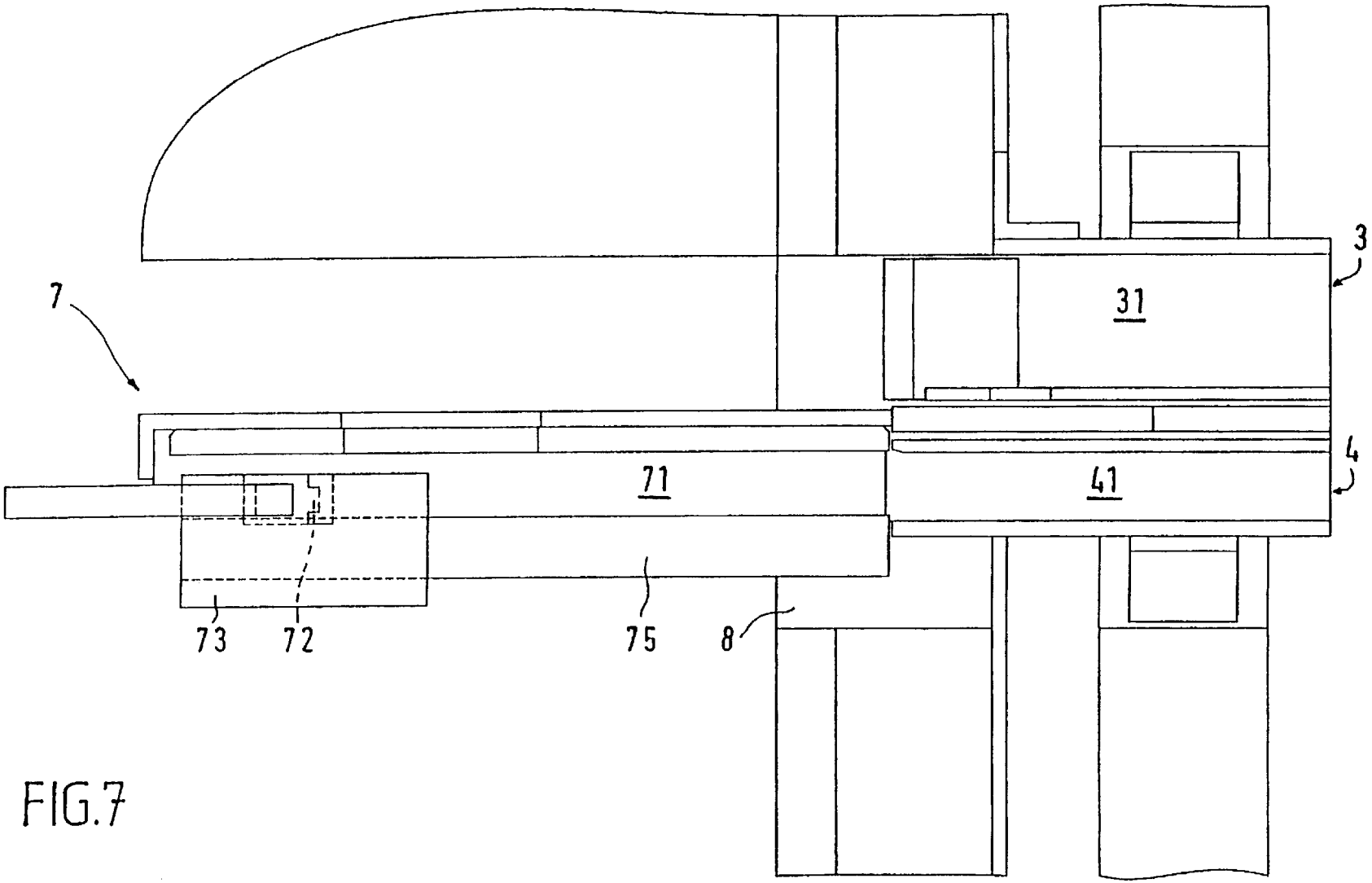
FIG. 7 shows a plan view of the product-part unloading part from FIG. 6
Figure 8:
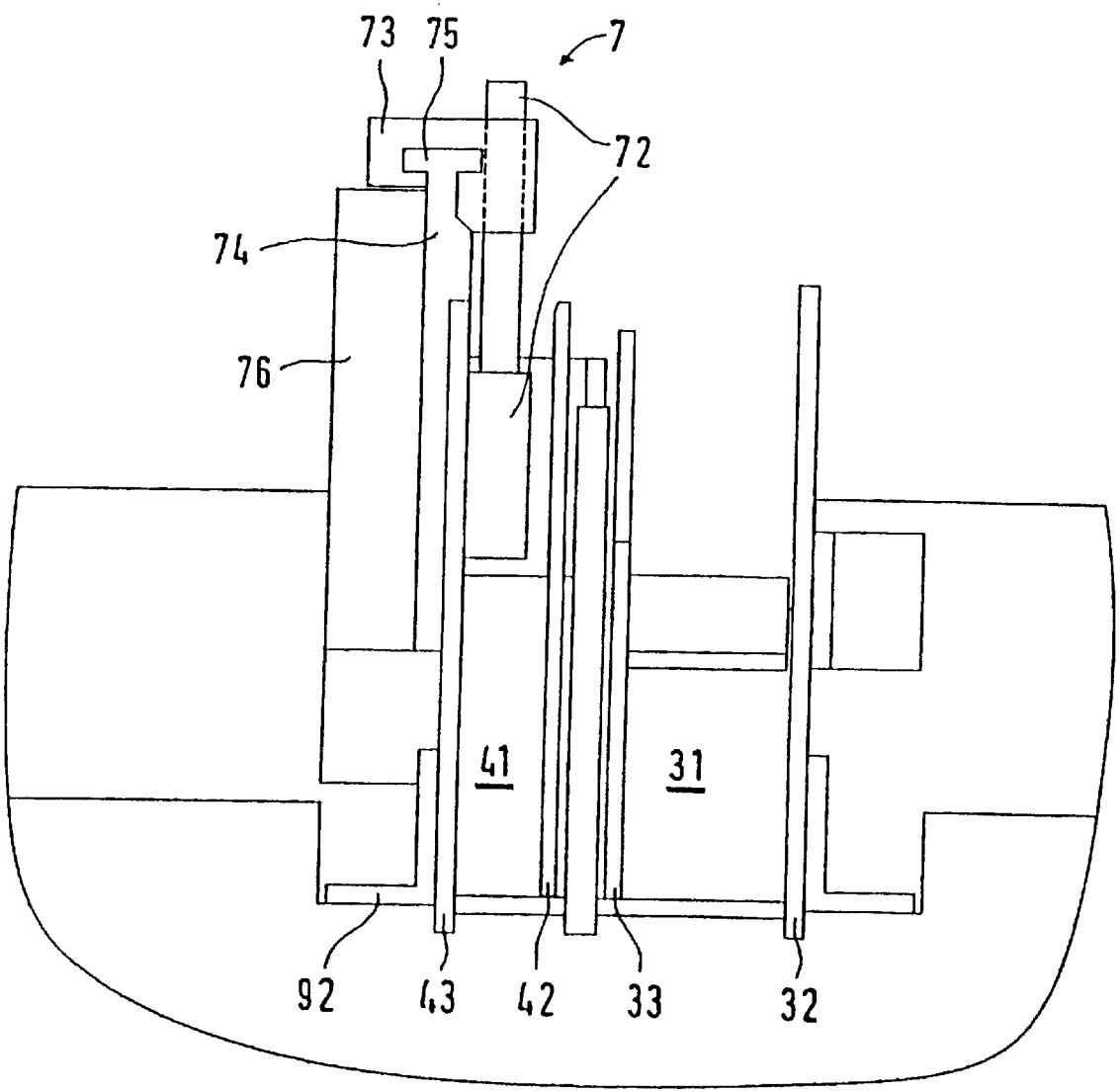
FIG. 8 shows a view from the front of the product-part unloading part from FIG. 6.

With reference to FIGS. 6 to 8, the product-part unloading part depicted here of a forming machine according to the invention differs from that represented in FIGS. 2–5 in that instead of a transfer device 6 with a kick lever 62 it has a transfer device 7 with a pusher 72. The pusher 72 is driven via a drive attachment location 722, for example by the upper tongs carrier 12 of the forming machine, and pushes with a pushing plate 721 a product part resting on the slideway 71 at the speed of the upper tongs carrier onto the chute 41 of the product-part discharge device 4. To stabilize the pusher movement, the pusher 72 is guided by a carriage 73, which it penetrates in a vertically displaceable manner. The carriage 73 itself is carried by a carriage guide 74 with a guide part 75 of a T-shaped design and has for this purpose a T-shaped groove. The guide part 75 and groove may, of course, also be differently designed, for example dovetailed, trapezoidal etc. The carriage guide 74 is fastened by means of an anchorage part 76 on the stripper 82 (not visible here).

The vertical displaceability of the pusher 72 in the carriage 73 makes it possible to raise the latter after reaching the extreme position on the side of the product-part discharge device, to return it into the opposite extreme position without the male die of the final forming station being touched, and then to lower it again into the starting position.

The transfer device 7 with pusher 72 has the advantage over the transfer device 6 with kick lever 62 that the product parts are moved relatively gently and no impact is exerted on them.

Further design variations can be realized with respect to the multi-stage forming machines described above. The following are also expressly mentioned here:

Instead of chutes 31 and 41, the product-part discharge devices 3 and 4 may have conveyor belts which are arranged horizontally or obliquely. It is also conceivable to provide drivers for transporting the product parts 21, 22.

The transfer tongs 51 may also have a lower gripper 53 with two gripping jaws. Touching of the chute 31 by the lower gripper 53 can be prevented by providing the chute 31 with a gap. Other transfer tongs, which for example have only an upper gripper, are also conceivable. Transfer tongs with only one gripper are suitable in particular for cold-forming machines.

The transfer devices 5, 6, 7 can be combined with one another in any way desired, it also being possible for a number of transfer devices to be of the same type and, for the discharge of more than two product parts, for the corresponding number of transfer devices and product-part discharge devices to be provided.

What is claimed is:

1. A multi-stage forming machine, comprising at least a first forming station, from which combined parts are transferred; a final forming station, at which said combined parts are divided into a plurality of product parts; first discharging means for discharging one of said product parts from said forming machine; second discharging means for discharging another of said product parts from said forming machine; first transferring means, including at least a first set of tongs, for transferring said one product part from said final forming station to said first discharging means; and second transferring means for transferring said another product part from said final forming station to said second discharging means.

2. A multi-stage forming machine according to claim 1, wherein said second transferring means includes a slideway positioned between said final forming station and said second discharging means and pushing means for pushing said one product part along said slideway toward said second discharging means.

3. A multi-stage forming machine according to claim 2, wherein said pushing means includes a kick lever mounted for pivotal movement relative to said slideway such that the pivotal movement of said kick lever imparts momentum to said one product part when said one product part is located on said slideway.

4. A multi-stage forming machine according to claim 3, wherein said kick lever is pivotable between a first position and a second position during its pivotal movement relative to said slideway.

5. A multi-stage forming machine according to claim 4, wherein said kick lever includes a kick plate positioned so as to contact said one product part during the pivotal movement of said kick lever from its said first position toward its said second position, thereby imparting momentum to said one product part.

6. A multi-stage forming machine according to claim 4 or 5, further comprising actuating means for actuating the pivotal movement of said kick lever from its said first position toward its said second position.

7. A multi-stage forming machine according to claim 6, further comprising urging means for urging said kick lever from its said second position toward its said first position.

8. A multi-stage forming machine according to claim 7, wherein said urging means includes a spring which is compressed when said kick lever is in its said second position and is extended when said kick lever is in its said first position.

9. A multi-stage forming machine according to claim 8, wherein said spring is compressed by a lever arm attached to said kick lever for pivotal movement conjointly therewith.

10. A multi-stage forming machine according to claim 9, wherein said actuating means includes said lever arm and at least one other moving part of said forming machine.

11. The multi-stage forming machine of claim 1, wherein said first set of tongs includes a first gripper and a second gripper spaced from said first gripper.

12. The multi-stage forming machine of claim 11, wherein said first gripper includes first and second gripping jaws; and wherein said second gripper includes a third gripping jaw.

13. The multi-stage forming machine of claim 11, wherein said first gripper is pretensioned.

14. The multi-stage forming machine of claim 11, further comprising a first tongs carrier on which said first gripper is mounted such that said first gripper is mounted for movement conjointly with said first tongs carrier, and a second tongs carrier on which said second gripper is mounted such that said second gripper is mounted for movement conjointly with said second tongs carrier.

15. The multi-stage forming machine of claim 14, further comprising a second forming station, first moving means for moving said first tongs carrier between a first position, in which said first tongs carrier is proximate said first forming station, and a second position, in which said first tongs carrier is proximate said second forming station, and second moving means for moving said second tongs carrier between a third position, in which said second tongs carrier is proximate said first forming station, and a fourth position, in which said second tongs carrier is proximate said second forming station.

16. The multi-stage forming machine of claim 15, further comprising a second set of tongs sized and shaped to transfer said combined parts from said first forming station to said second forming station.

17. The multi-stage forming machine of claim 16, wherein said second set of tongs includes a third gripper and a fourth gripper spaced from said third gripper.

18. The multi-stage forming machine of claim 17, wherein said third gripper is mounted on said first tongs carrier for conjoint movement therewith and said fourth gripper is mounted on said second tongs carrier for conjoint movement therewith.

19. The multi-stage forming machine of claim 18, wherein said third gripper moves between said first forming station and said second forming station as said first tongs carrier moves between said first and second positions; and wherein said fourth gripper moves between said first forming station and said second forming station as said second tongs carrier moves between said third and fourth positions.

* * * * *

UNITED STATES PATENT AND TRADEMARK OFFICE

CERTIFICATE OF CORRECTION

PATENT NO. : 6,471,035 B1
APPLICATION NO. : 09/424894
DATED : October 29, 2002
INVENTOR(S) : Daniel Ruchti et al.

It is certified that error appears in the above-identified patent and that said Letters Patent is hereby corrected as shown below:

In Column 1, line 60, insert --.-- after "invention".

In Column 1, line 60, delete "design variants emerge from the".

Signed and Sealed this

Eighth Day of April, 2008

JON W. DUDAS
*Director of the United States Patent and Trademark Office*